US006133676A

United States Patent [19]

Chen

[11] Patent Number: 6,133,676

[45] Date of Patent: Oct. 17, 2000

[54] DOUBLE-ENVELOPED HALOGEN BULB PROVIDED WITH PROTUBERANCES IN THE OUTER SURFACE OF THE ENVELOPE

[76] Inventor: Chun Tsun Chen, Fl. 3, 143, Der-Kuang Rd., Chun-Ho City, Taipei Hsien, Taiwan

[21] Appl. No.: 09/079,605

[22] Filed: May 15, 1998

[30] Foreign Application Priority Data

Sep. 10, 1997 [TW] Taiwan ..... 86215523
Mar. 25, 1998 [CN] China ..... 98 2 02732

[51] Int. Cl.[7] ..... H01J 1/02; H01J 61/52; H01J 7/24; H01K 1/58

[52] U.S. Cl. ..... 313/25; 313/17; 313/579; 313/624; 313/634; 313/569; 313/573

[58] Field of Search ..... 313/17, 25, 26, 313/569, 573, 578, 579, 624, 634

[56] References Cited

U.S. PATENT DOCUMENTS

| | | | |
|---|---|---|---|
| D. 413,171 | 8/1999 | Chen | D26/2 |
| 4,591,752 | 5/1986 | Thouret et al. | 313/25 |
| 4,595,859 | 6/1986 | Steiner et al. | 313/579 |
| 4,598,225 | 7/1986 | Gagnon | 313/17 |
| 4,720,652 | 1/1988 | DuBois, Jr. | 313/25 |
| 4,771,207 | 9/1988 | Page | 313/25 |
| 4,947,078 | 8/1990 | Rice et al. | 313/25 |
| 5,241,238 | 8/1993 | Westlund, Jr. et al. | 313/25 |
| 5,250,872 | 10/1993 | Wakimizu et al. | 313/25 |
| 5,287,037 | 2/1994 | Malinowski | 313/25 |
| 5,576,591 | 11/1996 | Block et al. | 313/25 |
| 5,670,840 | 9/1997 | Lanese et al. | 313/25 |
| 5,896,004 | 4/1999 | Feldman et al. | 313/17 |

FOREIGN PATENT DOCUMENTS

| | | |
|---|---|---|
| 0 276 780 | 8/1988 | European Pat. Off. . |
| 0 306 269 | 3/1989 | European Pat. Off. . |
| 0 589 695 | 3/1994 | European Pat. Off. . |
| 0 590 602 | 4/1994 | European Pat. Off. . |
| 5-335002 | 12/1993 | Japan . |
| 6-310109 | 11/1994 | Japan . |
| 8-129992 | 5/1996 | Japan . |
| 9-167599 | 6/1997 | Japan . |
| 9-237609 | 9/1997 | Japan . |
| 2 135 821 | 9/1984 | United Kingdom . |
| 2 136 201 | 9/1984 | United Kingdom . |
| 2 272 569 | 5/1994 | United Kingdom . |
| 85/01833 | 4/1985 | WIPO . |

*Primary Examiner*—Michael H. Day
*Assistant Examiner*—Mariceli Santiago
*Attorney, Agent, or Firm*—Seidel, Gonda, Lavorgna & Monaco, PC

[57] ABSTRACT

A halogen bulb is composed essentially of a tubular halogen bulb having two conductive ends, a thick hollow glass envelope and a socket for holding securely the tubular halogen bulb in the thick hollow glass envelope. The thick glass envelope has a thickness ranging between about 2 mm and about 8 mm, which is made integrally or made of two component parts joined together. The thick hollow glass envelope may be provided with protuberances perpendicular to an outer surface opposite to the socket, and/or ventilation holes to reduce the temperature of the double-enveloped halogen bulb at work. The socket may be provided with one or more ventilation holes at the closed end thereof. A bracket is used inside the thick hollow glass envelope for holding the tubular halogen bulb such that the tubular halogen bulb is perpendicular to the longitudinal axis of socket. The present invention also discloses an inverted-U-shaped lead soldered to one of the two conductive ends, which is able to support the tubular halogen bulb such that the tubular halogen bulb is parallel to the longitudinal axis of socket.

36 Claims, 14 Drawing Sheets

FIG.4
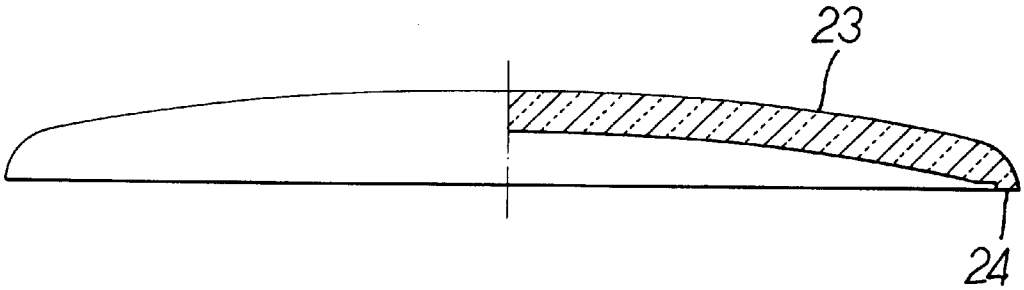
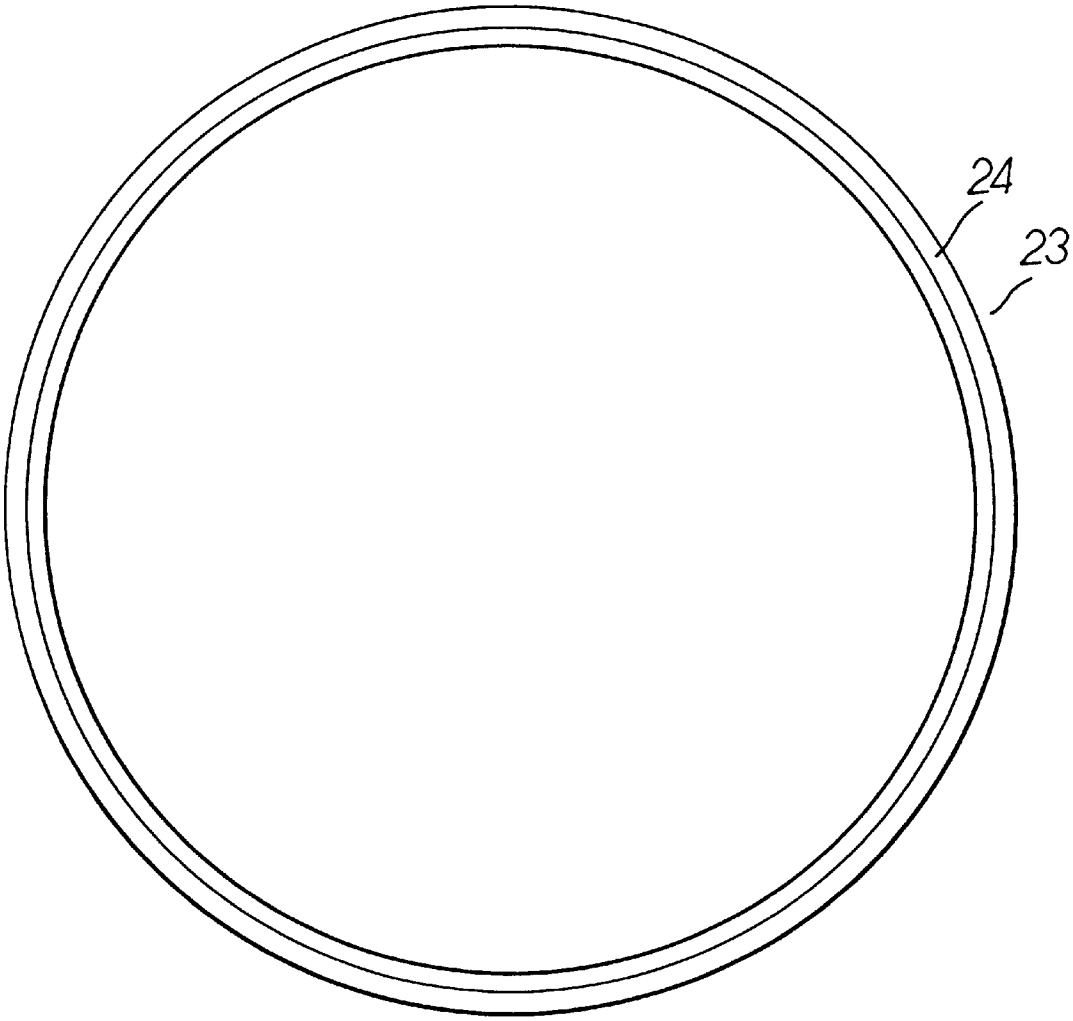
FIG.4a

DOUBLE-ENVELOPED HALOGEN BULB PROVIDED WITH PROTUBERANCES IN THE OUTER SURFACE OF THE ENVELOPE

FIELD OF THE INVENTION

The present invention relates generally to a halogen bulb, and more particularly to a double-enveloped halogen bulb which can be directly fitted into an electrical socket without the use of a protective case.

BACKGROUND OF THE INVENTION

The halogen bulbs are generally grouped into a low-wattage (1–100 watts) single-ended halogen bulb and a high-wattage (101–500 watts) tubular double-ended halogen bulb. The single-ended halogen bulb is generally fitted into a domelike case similar to the light bulb of a flashlight or car light and is mounted in a ceiling or wall for lighting or auxiliary lighting. The tubular double-ended halogen bulb was generally used for outdoor projection and is used in recent years in the indoor floor lamp for upward projection. The high-wattage tubular double-ended halogen bulb generates heat with a low risk of explosion. In order to prevent a fire caused by a foreign object which happens to make contact with the hot halogen bulb, the tubular double-ended halogen bulb must be shielded by a protective case. It is therefore readily conceivable that a lighting fixture provided with a high-wattage tubular double-ended halogen bulb has at least two shortcomings which have to be properly addressed. In the first place, the tubular double-ended halogen bulb must be made and sold along with a protective case, thereby resulting in an increase in the cost of shipping and storage. In addition, it is almost impossible or very difficult for the consumer to replace a damaged or burn-out tubular double-ended halogen bulb.

SUMMARY OF THE INVENTION

The primary objective of the present invention is therefore to provide a double-enveloped halogen bulb which is compatible with the conventional electrical socket of a lighting fixture and can be so used without a protective case.

In keeping with the principle of the present invention, the foregoing objective of the present invention is attained by the double-enveloped halogen bulb which is basically made up of a tubular halogen bulb having two conductive ends, a hollow glass envelope, and a socket for fixing the tubular halogen bulb in the hollow glass envelope.

The conductive ends of the tubular halogen bulb are electrically connected with two different localities of the socket. The tubular halogen bulb further has a quartz envelope, a metal filament which is located in the quartz envelope such that both ends of the metal filament are sealed at both ends of said quartz envelope and electrically connected to said two conductive ends separately, and a halogen gas mixture contained hermetically in the quartz envelope.

The tubular halogen bulb suitable for application in the present invention should have a wattage ranging between 25 watts and 500 watts, preferably 60 watts or more. The tubular halogen bulb is currently available in the market place and is made by, for examples, GE (General Electric) of the United states of Philips of The Netherlands.

The hollow glass envelope of the present invention has a thickness ranging between 2 mm and 8 mm, preferably between 3 mm and 6 mm. The hollow glass envelope is made of a conventional glass material, preferably a glass material containing 95% of borosilicate. The hollow glass envelope has an outer surface which is either polished or sanded. The hollow glass envelope of the present invention is intended to protect a person or an animal contiguous to the bulb from a bodily injury in the event that the tubular halogen bulb explodes. In addition, the hollow glass envelope of the present invention serves as a heat insulator for preventing a fire or explosion caused by a foreign object which is inadvertently caused to make contact with the overheated tubular halogen bulb.

The hollow glass envelope of the present invention has a neck, an opening located at one end of the neck, and a head located at another end of the neck. The opening end of the neck is received in an opening of the socket and fastened therein.

Preferably, the head of the hollow glass envelope of the present invention has a plurality of bulges perpendicular to an outer surface thereof. The outer surface of the hollow glass envelope may be a plain surface opposite to the socket and has an area ranging between 3,000 $mm^2$ and 14,000 $mm^2$. The bulges have a height ranging between 3 mm and 10 mm. The bulges may be cylindrical, blocklike or striplike in shape. The cylindrical or blocklike bulges each has a top area ranging between 5 $mm^2$ and 25 $mm^2$ and are equidistantly distributed on the outer surface of the hollow glass envelope. These bulges are distributed at an interval ranging between 2 mm and 10 mm. The striplike bulges have a width ranging between 3 mm and 10 mm, and a length equal to or slightly shorter than a linear distance between two opposite edges of the outer surface of the hollow glass envelope. Preferably, the striplike bulges are equidistantly distributed on the outer surface of the hollow glass envelope such that the bulges are parallel to one another, and that the bulges are distributed at an interval ranging between 3 mm and 10 mm. These bulges have a cooling effect and serve to minimize the contact area between the overheated surface and a foreign object which happens to fall on the overheated surface. In addition, the air circulation takes place between two bulges so as to bring about the cooling effect at such time when the foreign object is supported on these bulges. As a result, the double-enveloped halogen bulb of the present invention has a prolonged life span of service and is relatively safe.

The hollow glass envelope of the present invention may be made integrally or made of two component parts which are combined to form the glass envelope. Generally speaking, the hollow glass envelope, which is either made integrally or made of the combination of two component parts, may be further provided with a plurality of air holes. Preferably, the air holes are constructed such that the tubular halogen bulb can not be seen directly by the naked eye through one of these air holes, so as to protect the persons from the broken pieces which may be ejected through the air holes at such time when the overheated tubular halogen bulb explodes. In addition, the air holes serve to cool the overheated halogen bulb.

If the glass envelope of the present invention if made integrally, the head of the hollow glass envelope may be round, oblong, spindle, cylindrical, bowl-shaped, or funnel-shaped. On the other hand, if the hollow glass envelope of the present invention is made of two component parts, the glass envelope has a cap and a funnel-shaped portion which has a first open end fastened with the socket, and a second open end with an opening greater than an opening of the first open end. The second open end of the funnel-shaped portion is capped by the cap which is attached to the second open end by an adhesive. Preferably, the cap and the second open end are provided with means enabling the cap and the second open end to become engaged with each other. For example, the cap may be provided with a protruded edge perpendicular to a surface facing the funnel-shaped portion, whereas the second open end of the funnel-shaped portion is provided at a portion contiguous to inner circumferential edge thereof with a protuberance corresponding in location to the protruded edge of the cap. As a result, the cap can be engaged with the second open end of the funnel-shaped portion right after the application of the adhesive. Alternatively, the surface of the cap facing the funnel-shaped portion may be provided along the edge thereof with a plurality of wedges which are separated from one another and perpendicular to the surface, whereas the second open end of the funnel-shaped portion is provided with a plurality of recesses corresponding in location and size to the wedges. The cap and the second open end of the funnel-shaped portion can be thus engaged with each other. In addition, the connecting portions of the cap and the funnel-shaped portion may be provided with a plurality of air holes. Preferably, the air holes are located in a portion contiguous to the second open end of the funnel-shaped portion.

The socket of the double-enveloped halogen bulb of the present invention may be a conventional socket of a tungsten-filament light bulb, a conventional socket of the double-post GU10 type, or new sockets created by the present inventor. The tungsten-filament light bulb socket has a hollow columnar body having an opening at one end and an electrically insulating closed end member fixed at another end of said hollow columnar body. Said hollow columnar body is made of metal, and said closed end member has a small central hole. The tubular halogen bulb of the present invention is engaged with the conventional tungsten-filament light bulb socket such that a lead connected to one of the two conductive ends of the tubular halogen bulb penetrates through the small central hole, and the protruding end thereof is bent prior to being fastened to the closed end member with a solder bump, and that another lead connected to another end of the two conductive ends is connected with the hollow columnar body. The hollow columnar body is provided in the inner wall thereof with threads while the outer wall of the neck of the hollow glass envelope is provided with threads which are engageable with the threads of the hollow columnar body.

A new type socket suitable for use in the present invention is similar to the conventional socket of the tungsten-filament light bulb, except that a closed end member of the new type socket is threadably mounted inside the hollow columnar body with a cylindrical end of said closed end member protruding from said another end of said hollow columnar body, wherein said closed end member is provided with two square holes and one round hole around said cylindrical end thereof; and said new type socket further has a copper hat having two fastening legs on the rim of the copper hat; and wherein the copper hat is fastened onto the protruding cylindrical end of the closed end member by inserting the two fastening legs into the two square holes of the closed end member and bending them toward each other. Said one of said two conductive ends or a lead connected to said one of said two conductive end of said tubular halogen bulb is passed through said round hole and soldered to said copper hat.

Preferably, said another lead is connected to said another end of said two conductive ends at one end thereof by soldering; and another end of said another lead is bent over an edge of the opening end of said neck and received in a first groove formed on the outer surface of the neck and perpendicular to the threads of the neck, so that said another end of said another lead is electrically connected to said hollow columnar body when said socket is threaded on the threads of the neck of the glass envelope. More preferably, said another lead is in an inverted-U-shaped lead having two hooks at both legs thereof, and said neck is further provided with a second groove on the outer surface thereof, wherein said inverted-U-shaped lead is connected to said another end of said two conductive ends at the middle portion thereof by soldering, and the two hooks are received in said first and second grooves separately, so that said two hooks are electrically connected to said hollow columnar body when said socket is threaded on the threads of the neck of the glass envelope.

The socket of the GU10 type is a hallow columnar body having an opening at one end and a closed end at another end thereof, and is made integrally of an electrically non-conductive material such as plastics, with the closed end of the socket being provided with two conductive posts separated from each other. Two additional leads are used to separately electrically connect the two conductive posts with the two conductive ends of the tubular halogen bulb of the present invention. The GU10 socket and the neck of the glass envelope of the present invention are preferably attached together by means of an adhesive, wherein said hollow columnar body of said socket has an inner diameter corresponding to an outer diameter of the neck of the glass envelope.

Preferably, the double-enveloped halogen bulb containing the GU10 socket or another new type of socket described in the following paragraph further comprises an inverted-U-shaped lead having two hooks at both legs thereof and two additional leads. Said neck of said glass envelop is further provided with two grooves on the outer surface thereof. Said inverted-U-shaped lead is connected to one of said two conductive ends of said tubular halogen bulb at the middle portion thereof by soldering, and the two hooks are received in said two grooves separately, wherein one leg of said inverted-U-shaped lead and another end of said two conductive ends of said tubular halogen bulb are electrically connected to said two conductive posts with said two additional leads separately.

Said another new type socket is a hallow columnar body having an opening at one end and a closed end at another end thereof, and is made integrally of a ceramic material, with the closed end thereof being provided with two conductive posts separated from each other, which is similar to the conventional socket of GU10 type in structure. However, said two conductive posts are hollow, one ends of the two additional leads are received inside the two hollow conductive posts and protruding therefrom separately, the protruding ends of the two additional leads are separately connected to one ends of the two hollow conductive posts by soldering, and another ends of the two additional leads are separately connected to said one leg of said inverted-U-shaped lead and said another end of said two conductive ends of said tubular halogen bulb by soldering.

Said another new type socket may be further with two axial protuberant guides on the inner wall of said hollow columnar body thereof, and said glass envelope is provided with two additional grooves corresponding to said two axial protuberant guides on an outer surface of said opening end of said neck thereof, so that the socket is non-rotatably mounted on the neck of the glass envelope with the two axial protuberant guides being received in the two additional grooves of said neck respectively.

Preferably, said GU10 socket and said another new type socket are fastened with said opening end of said neck of said glass envelope by a ceramic cement.

Preferably, said two conductive posts of said GU10 socket and said another new type socket are separately received in two through holes provided at said closed ends of said sockets and fastened by means of a ceramic cement.

Preferably, said GU10 socket and said another new type socket are further provided with one or more ventilation holes at said closed ends thereof.

In the double-enveloped halogen bulb discussed above, the tubular halogen bulb of the present invention is preferably fixed in the hollow glass envelope such that the longitudinal axis of the tubular halogen bulb is substantially parallel to the longitudinal axis of the socket. Selectively, the tubular halogen bulb of the present invention is fixed in the hollow glass envelope such that the longitudinal axis of the tubular halogen bulb is substantially perpendicular to the longitudinal axis of the socket. When the longitudinal axis of the tubular halogen bulb is perpendicular to the longitudinal axis of the socket, the tubular halogen bulb is preferably supported by a bracket which is provided at one end thereof with two legs and at another end thereof with tow arms. The two legs of the bracket are respectively fastened with the socket and between the socket and the neck of the hollow glass envelope, or at two locations between the socket and the neck of the hollow glass envelope. The two arms of the bracket are intended to hold the tubular halogen bulb.

The features and the functions of the present invention will be more readily understood upon a thoughtful deliberation of the following detailed description of the embodiments of the present invention with reference to the accompanying drawings.

BRIEF DESCRIPTION OF THE DRAWINGS

FIG. 4 shows a partial sectional view of a cap of the double-enveloped halogen bulb of the second preferred embodiment of the present invention.

FIG. 4*a* shows a bottom view of the cap of the double-enveloped halogen bulb of the second preferred embodiment of the present invention.

DETAILED DESCRIPTION OF THE PREFERRED EMBODIMENTS

EMBODIMENT 1

Figure 1:
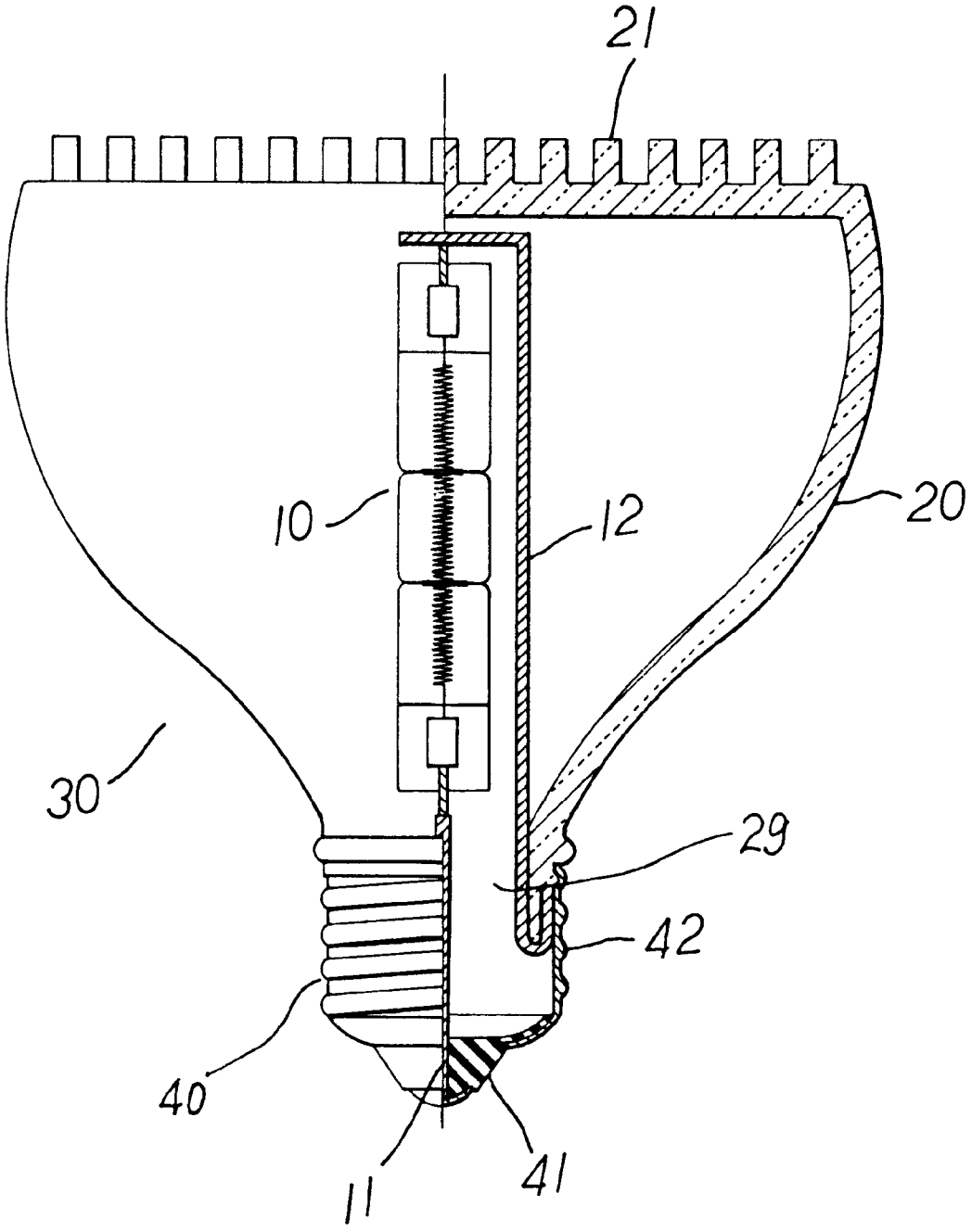
FIG. 1 shows a partial sectional view of a double-enveloped halogen bulb of a first preferred embodiment of the present invention.

As shown in FIG. 1, a double-enveloped halogen bulb 30 of the first preferred embodiment of the present invention is composed of a tubular halogen bulb 10 having two conductive ends, a hollow glass envelope 20, and a socket 40 for holding securely the tubular halogen bulb 10 inside the hollow glass envelope 20.

Figure 2:
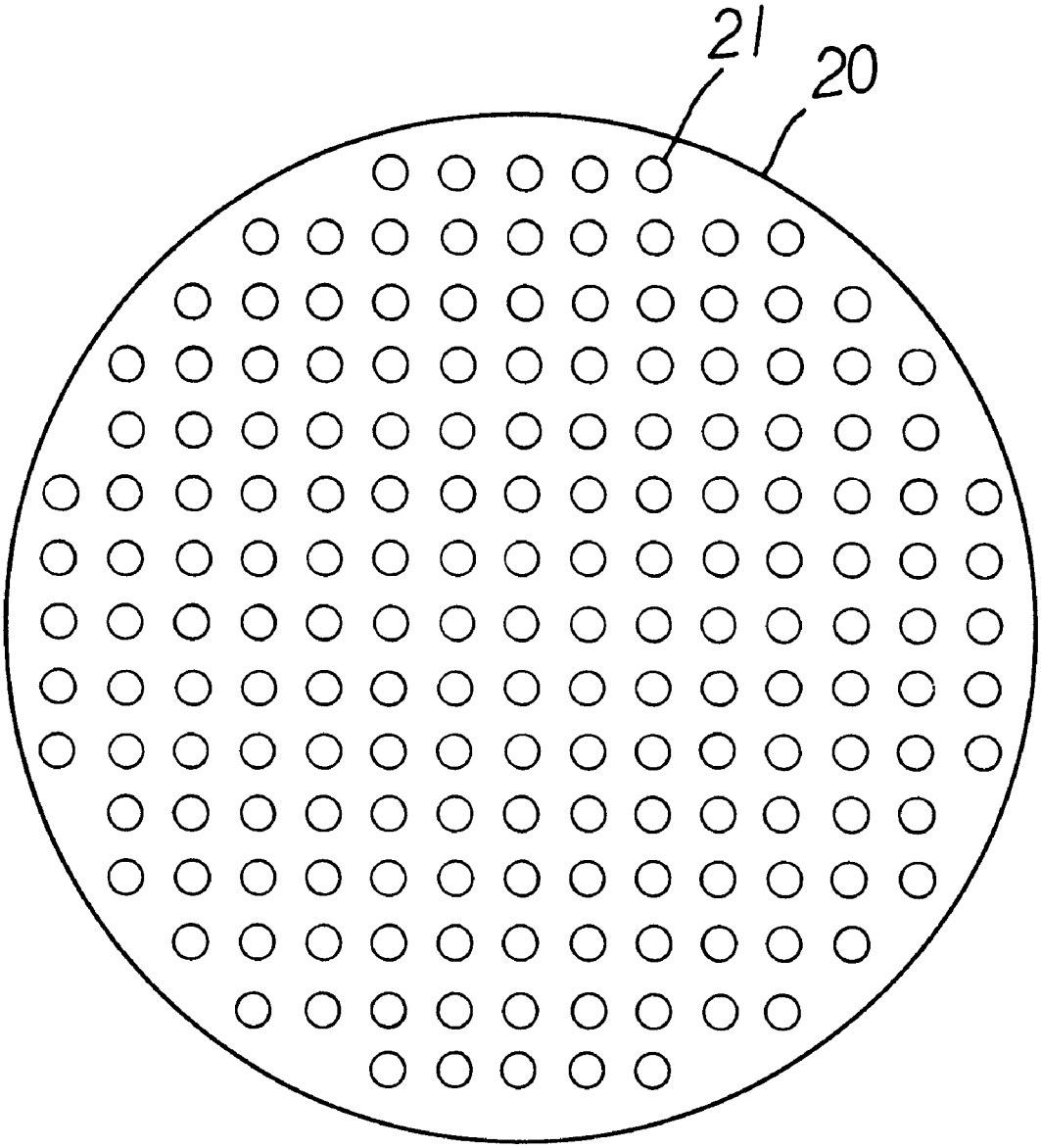
FIG. 2 shows a top view of the double-enveloped halogen bulb of the first preferred embodiment of the present invention.

The hollow glass envelope 20 is made integrally of 95% borosilicate glass and has a thickness of 4 mm. The outer surface of the hollow glass envelope 20 is polished by sanding. As shown in FIGS. 1, and 2, the top surface of the head of the hollow glass envelope 20 has a plurality of cylindrical protuberances 21 perpendicular to the top surface of the head and having a height of 5 mm and a diameter of 3 mm. The top surface of the head is a circular plane and has a radius of 46.8 mm. The cylindrical protuberances 21 are equidistantly arranged on the top surface of the head at an interval of 3 mm. The neck of the glass envelope 20 is provided at the lower end thereof with an opening 29 and is further provided in the outer surface thereof with male threads engageable with the socket 40.

The socket 40 has a hollow columnar body 42 having an opening at one end and a closed end at another end thereof. The closed end is made of an insulating material 41 with a small central hole (not shown in the drawings), whereas the hollow columnar body 42 is made of a metal material and is provided therein with female threads corresponding in location to and engageable with the male threads of the neck of the glass envelope 20. A lead 11 is connected with one of the two conductive ends of the tubular halogen bulb 10 at one end thereof, and another end thereof juts out from the small central hole, wherein the protruding end of the lead 11 is bent and soldered to the closed end 41. Another lead 12 is connected with another end of another conductive ends at one end thereof, and another end thereof is bent over the edge of the opening end of the neck of the glass envelope 20 such that the another end of the lead 12 is intimately attached to a vertical groove located on the male threads of the outer surface of the neck, and that the lead 12 is electrically connected with the metal columnar body 42 when the metal columnar body 42 is threaded on the male threads of the neck.

The tubular halogen bulb 10 of the double-enveloped halogen bulb 30 of the first preferred embodiment of the present invention has a wattage ranging between 60W and 300W. The double-enveloped halogen bulb 30 is provided with the socket 40 which is compatible with the conventional tungsten-filament light bulb. In view of the glass envelope 20, the double-enveloped halogen bulb 30 is devoid of a protective case.

EMBODIMENT 2

Figure 3:
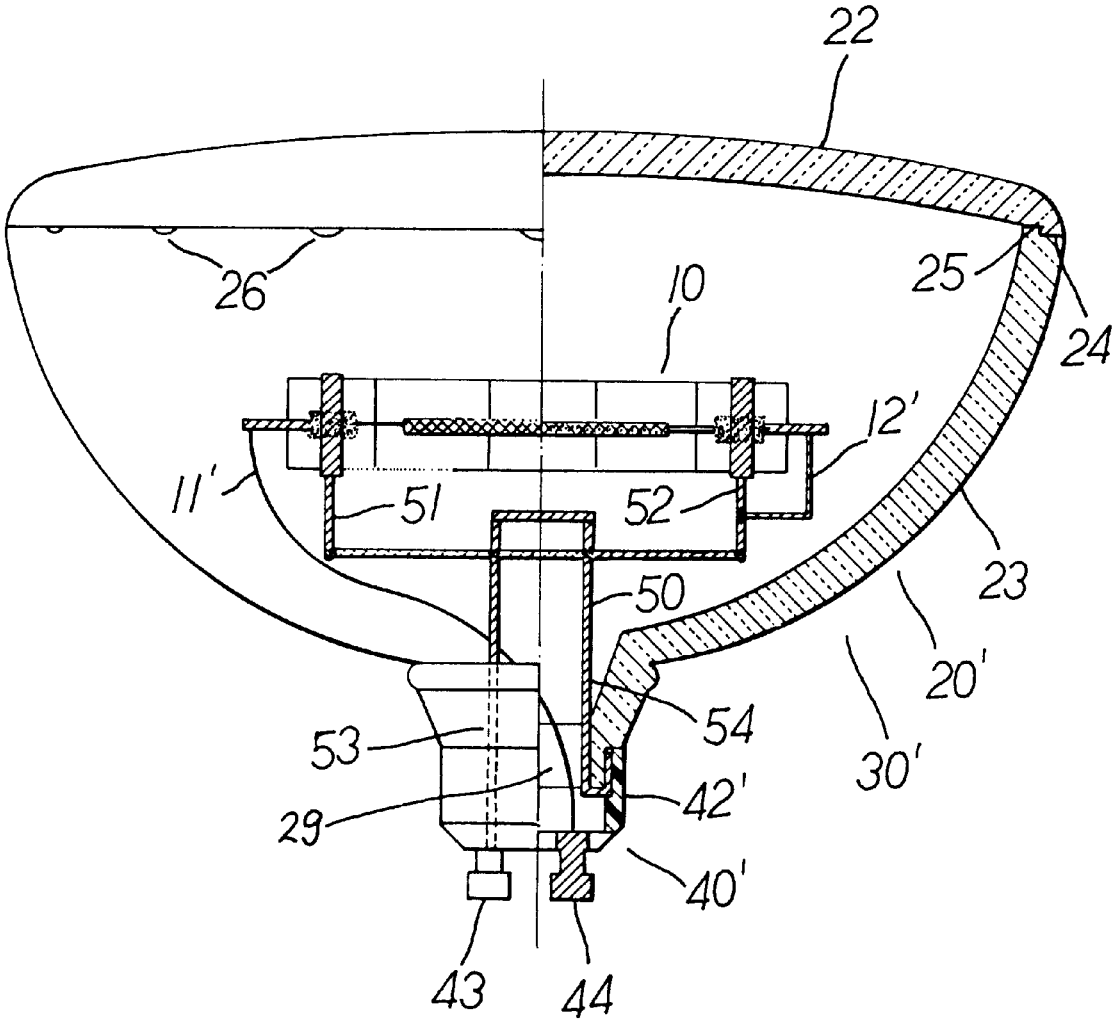
FIG. 3 shows a partial sectional view of a double-enveloped halogen bulb of a second preferred embodiment of the present invention.

As shown in FIG. 3, a double-enveloped halogen bulb 30' of the second preferred embodiment of the present invention consists of a tubular halogen bulb 10 having two conductive ends, a hollow glass envelope 20', a socket 40' for securing the tubular halogen bulb 10 inside the hollow glass envelope 20', and a bracket 50 of a metal material for supporting the tubular halogen bulb 10.

Figure 5:
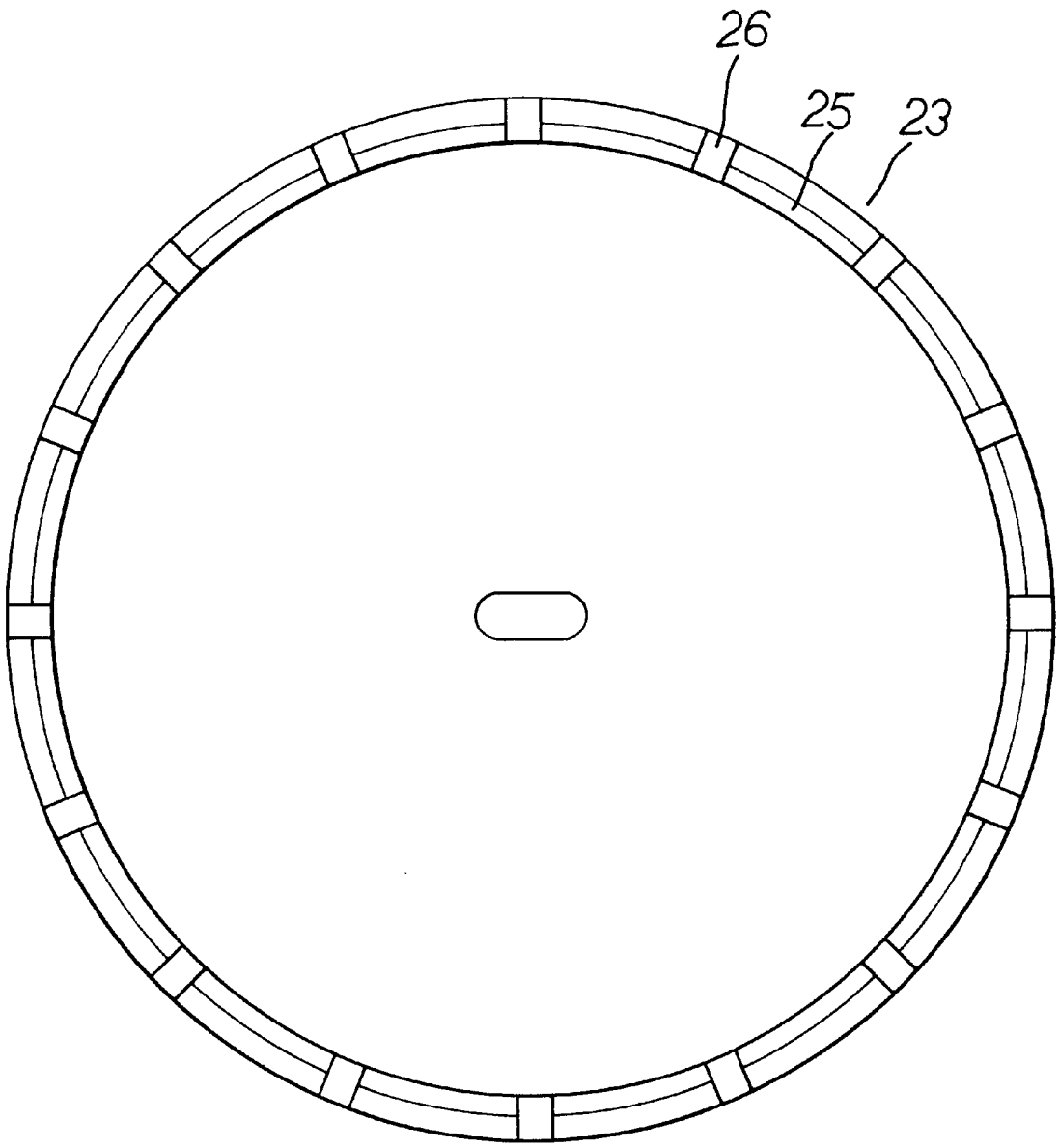
FIG. 5 shows a top view of a funnel-shaped portion of the double-enveloped halogen bulb of the second preferred embodiment of the present invention.

The glass envelope 20 has a cap 22 and a funnel-shaped portion 23. Both the cap 22 and the funnel-shaped portion 23 are made of 95% borosilicate glass. The funnel-shaped portion 23 has one end, which is provided with a smaller opening 29 and is fastened securely with the socket 40', whereas the funnel-shaped portion 23 has another end, which is provided with a larger opening and is capped with the cap 22. As shown in FIGS. 4 and 4*a,* the cap 22 is provided in the underside of the circumferential edge thereof with a protruded edge 24 perpendicular to the underside. As shown in FIG. 5, another end (with the larger opening) of the funnel-shaped portion 23 is provided in the vicinity of the inner circumferential edge of the top surface thereof with a protuberance 25 corresponding in location to the protruded edge 24. The cap 22 is therefore engageable with another end of the funnel-shaped portion 23. In fact, the cap 22 is fastened securely with another end of the funnel-shaped portion 23 by means of an adhesive.

The socket 40' is of the GU10 type and is provided with a hollow columnar body 42' of a plastic material, and two metal bodies 43 and 44 which are fastened with the closed end of the hollow columnar body 42'. The socket 40' is fastened securely with one end (with the smaller opening 29) of the funnel-shaped portion 23 of the glass envelope 20' by means of an adhesive.

Prior to the processes of fastening the cap 22 with the funnel-shaped portion 23 and of fastening the socket 40' with the glass envelope 20', the tubular halogen bulb 10 must be mounted in the funnel-shaped portion 23 of the glass envelope 20' such that the proximity of both ends of the tubular halogen bulb 10 are held by two arms 51 and 52 of the bracket 50. A leg 53 of the bracket 50 is fastened with the metal body 43 of the socket 40' by soldering. Another leg 54 is bent over the edge of the smaller opening end of the funnel-shaped portion 23 and is bound between the socket 40' and the funnel-shaped portion 23 of the glass envelope 20'. An electrically lead 11' is used to connect one of the two conductive ends of the tubular halogen bulb 10 with the metal body 44 of the socket 40'. Another electrically-conductive lead 12', which is connected with another end of the two conductive ends of the tubular halogen bulb 10, is soldered with the metal bracket 50 and is therefore electrically connected with the metal body 43 of the socket 40'.

As shown in FIG. 3, the glass envelope 20' has a plurality of ventilation holes 26, which are located in the another end (with the larger opening) of the funnel-shaped portion 23'.

The tubular halogen bulb 10 of the double-enveloped halogen bulb 30' is horizontally located so as to minimize the height of the glass envelope 20', thereby making the double-enveloped halogen bulb 30' suitable for use in an environment in which a height limitation is called for. In addition, the effect of cooling the double-enveloped halogen bulb 30' at work is attained by means of the ventilation holes 26.

EMBODIMENT 3

Figure 6:
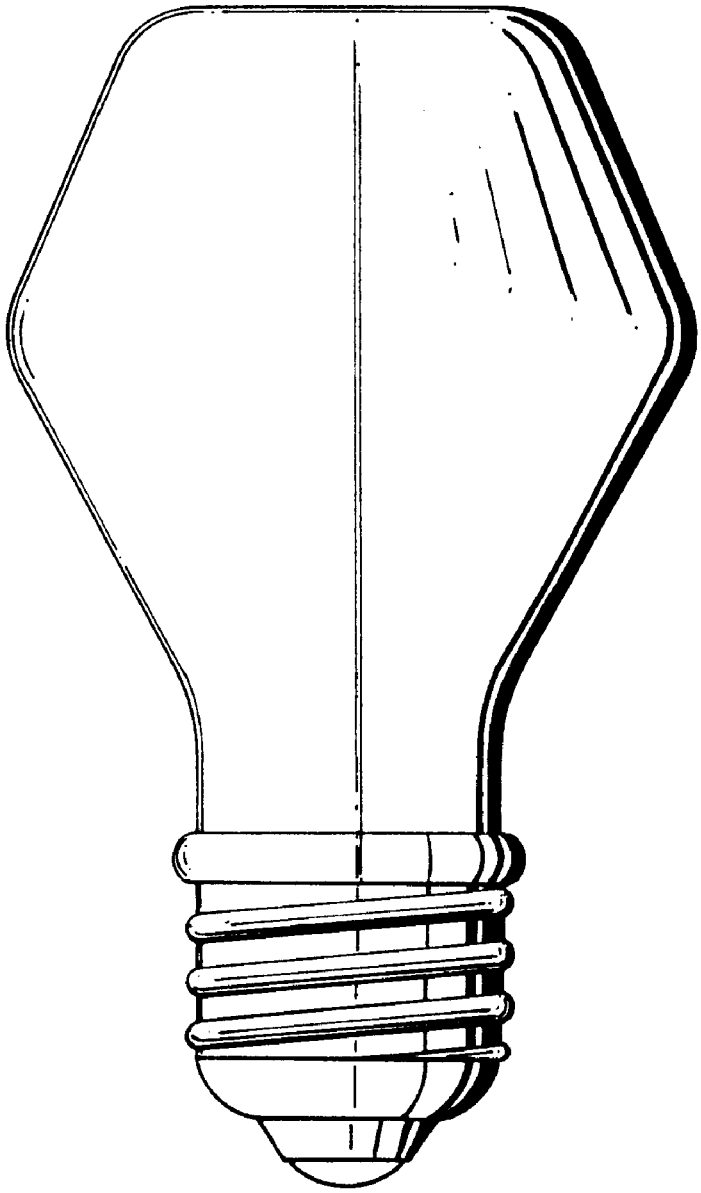
FIG. 6 shows a perspective view of a double-enveloped halogen bulb of a third preferred embodiment of the present invention.

As illustrated in FIG. 6, a double-enveloped halogen bulb of the third preferred embodiment of the present invention is basically similar to that of the first preferred embodiment of the present invention, with the only difference being that the former consists of a hollow glass envelope which is different in shape from the hollow glass envelope of the latter.

EMBODIMENT 4

Figure 7:
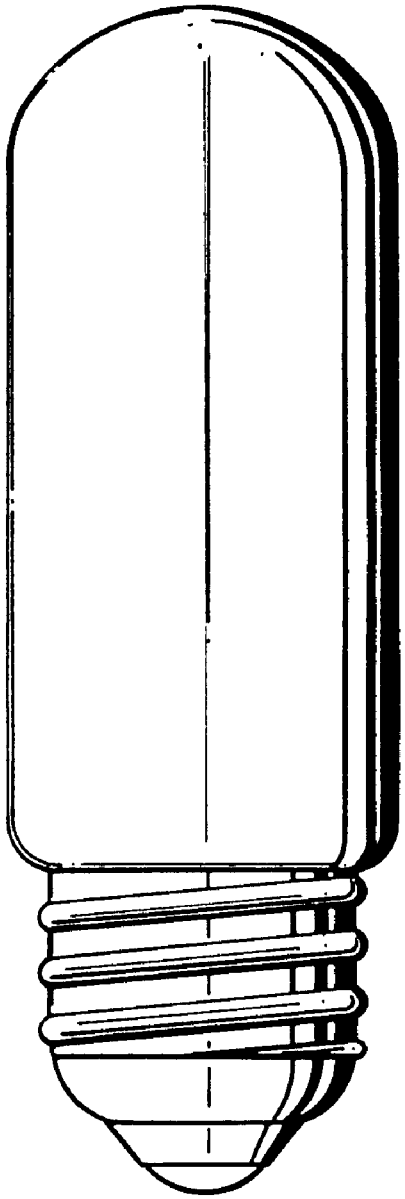
FIG. 7 shows a perspective view of a double-enveloped halogen bulb of a fourth preferred embodiment of the present invention.

As shown in FIG. 7, a double-enveloped halogen bulb of the fourth preferred embodiment of the present invention is basically similar to that of the first preferred embodiment of the present invention, except that the former consists of a hollow glass envelope different in shape from the hollow glass envelope of the double-enveloped halogen bulb of the latter.

EMBODIMENT 5

Figure 8:
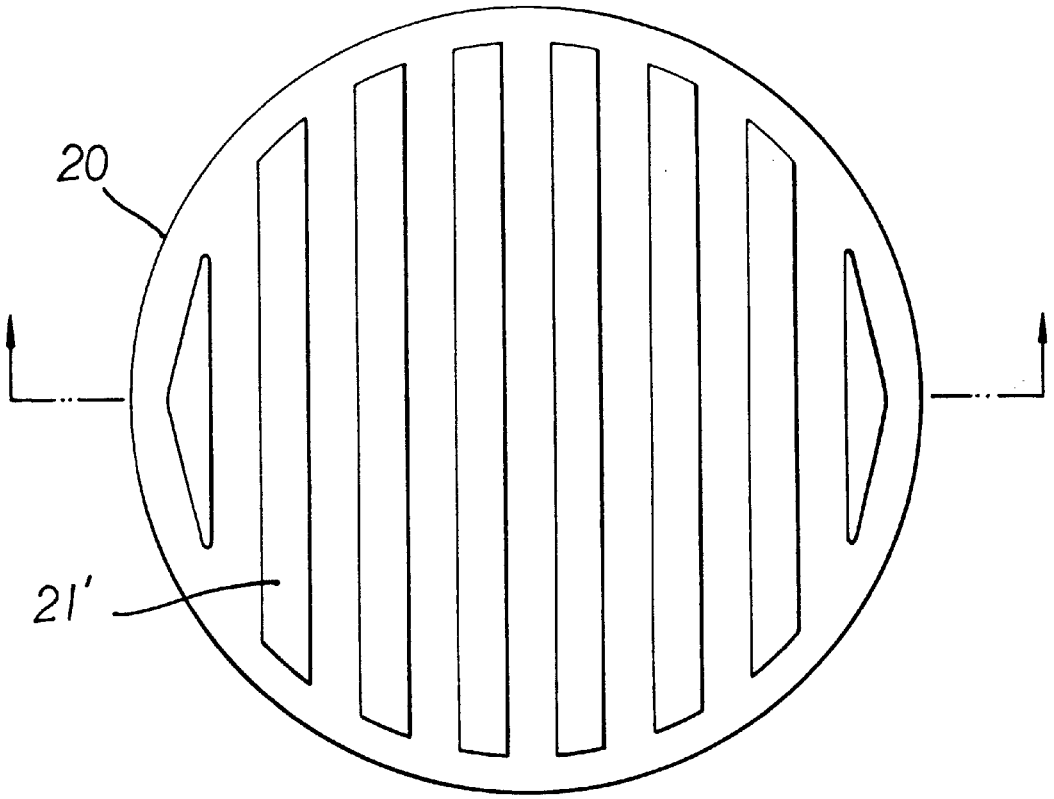
FIG. 8 shows a top view of a double-enveloped halogen bulb of a fifth preferred embodiment of the present invention.
Figure 9:
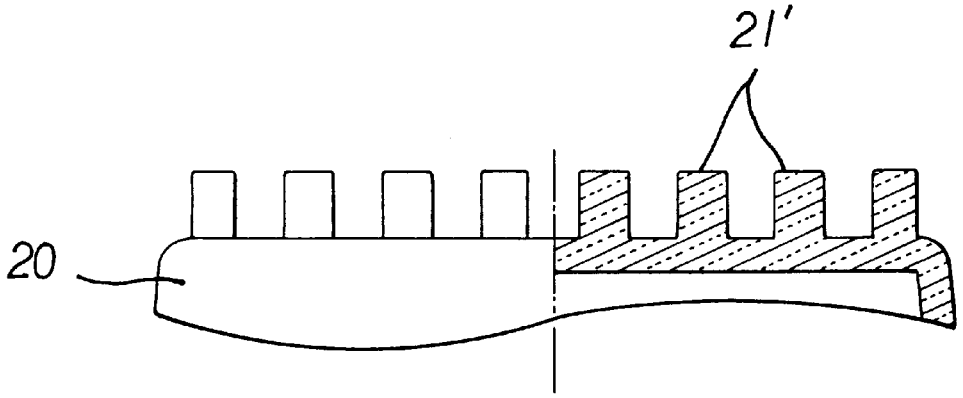
FIG. 9 shows a partial sectional view of the double-enveloped halogen bulb of the fifth preferred embodiment of the present invention.

As shown in FIGS. 8 and 9, a double-enveloped halogen bulb of the fifth preferred embodiment of the present invention is similar in construction to that of the first preferred embodiment of the present invention, except that the former consists of a hollow glass envelope 20 which is provided on the top surface thereof with a plurality of parallel ridges 21' separated equidistantly at an interval of 6 mm. The ridges 21' have a height of 8 mm. Two of the ridges 21' which are located at the far right and the far left are flat triangular in form and 5.3 mm in width. Those ridges 21' which are located between the two triangular ridges 21' are in the form of stripe and are 6 mm in width. The ridges 21' have various lengths, which are smaller than the linear distance between the two opposite points on the circumference of the top surface.

EMBODIMENT 6

Figure 10:
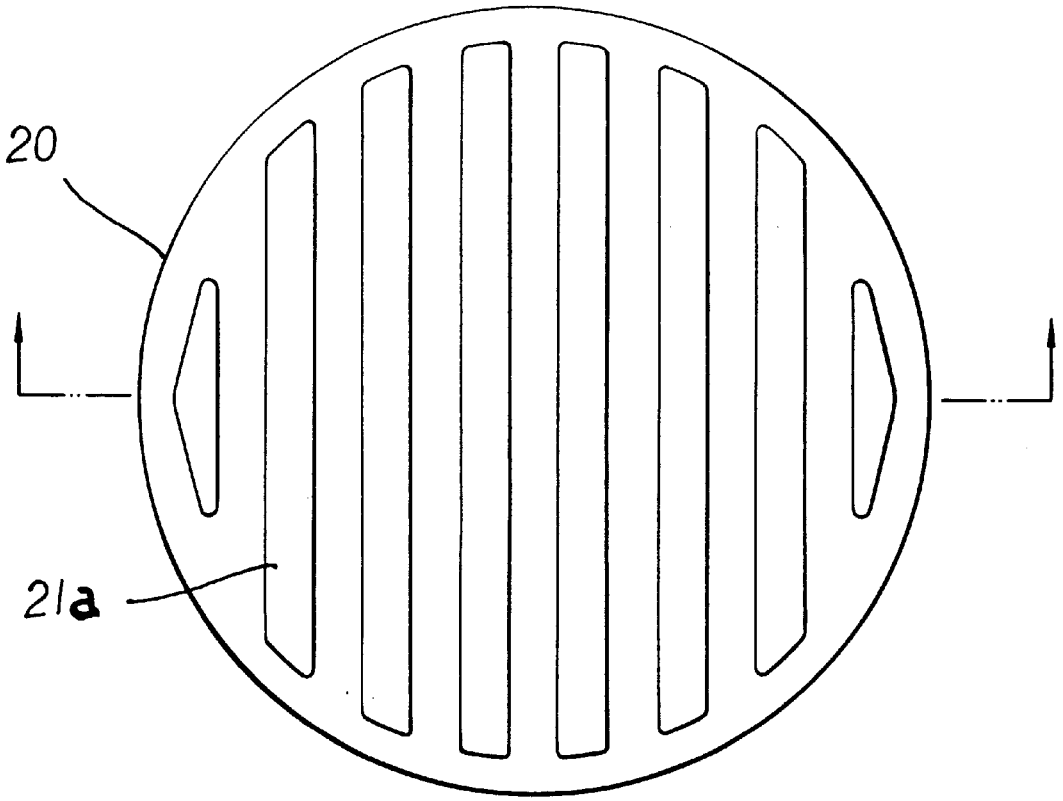
FIG. 10 shows a top view of a double-enveloped halogen bulb of a sixth preferred embodiment of the present invention.
Figure 11:
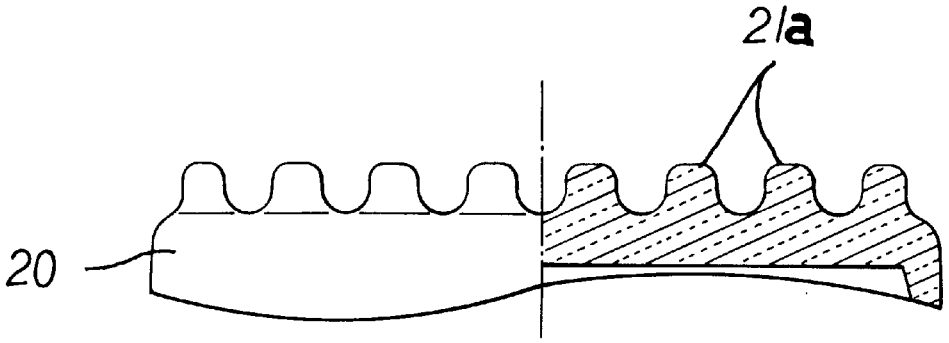
FIG. 11 shows a partial sectional view of the double-enveloped halogen bulb of the sixth preferred embodiment of the present invention.

As shown in FIGS. 10 and 11, a double-enveloped halogen bulb of the sixth preferred embodiment of the present invention is similar in construction to that of the fifth preferred embodiment of the present invention, except that the former has a plurality of parallel ridges 21*a* on the top surface of the hollow glass envelope 20 which are lower in height (6 mm) and are chamfered at the longitudinal edges thereof. In addition, the groove between any two ridges 21*a* is concave-up in a cross-section view.

EMBODIMENT 7

Figure 12:
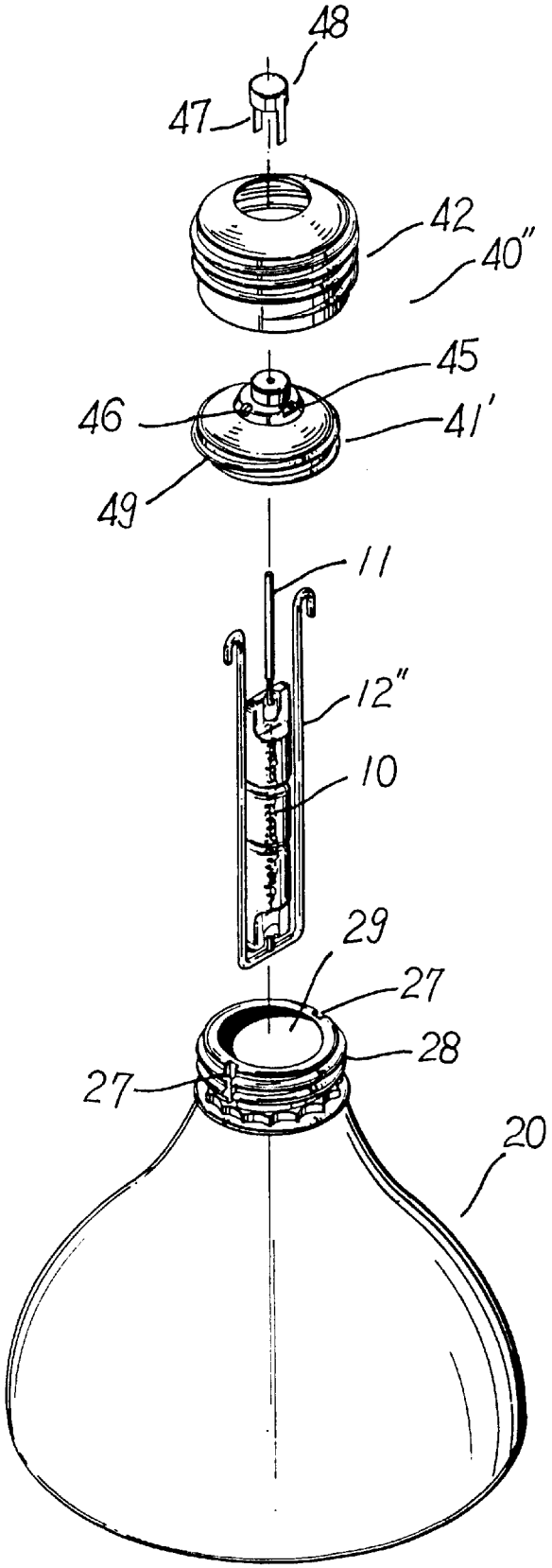
FIG. 12 shows an exploded view of a double-enveloped halogen bulb of a seventh preferred embodiment of the present invention.
Figure 13:
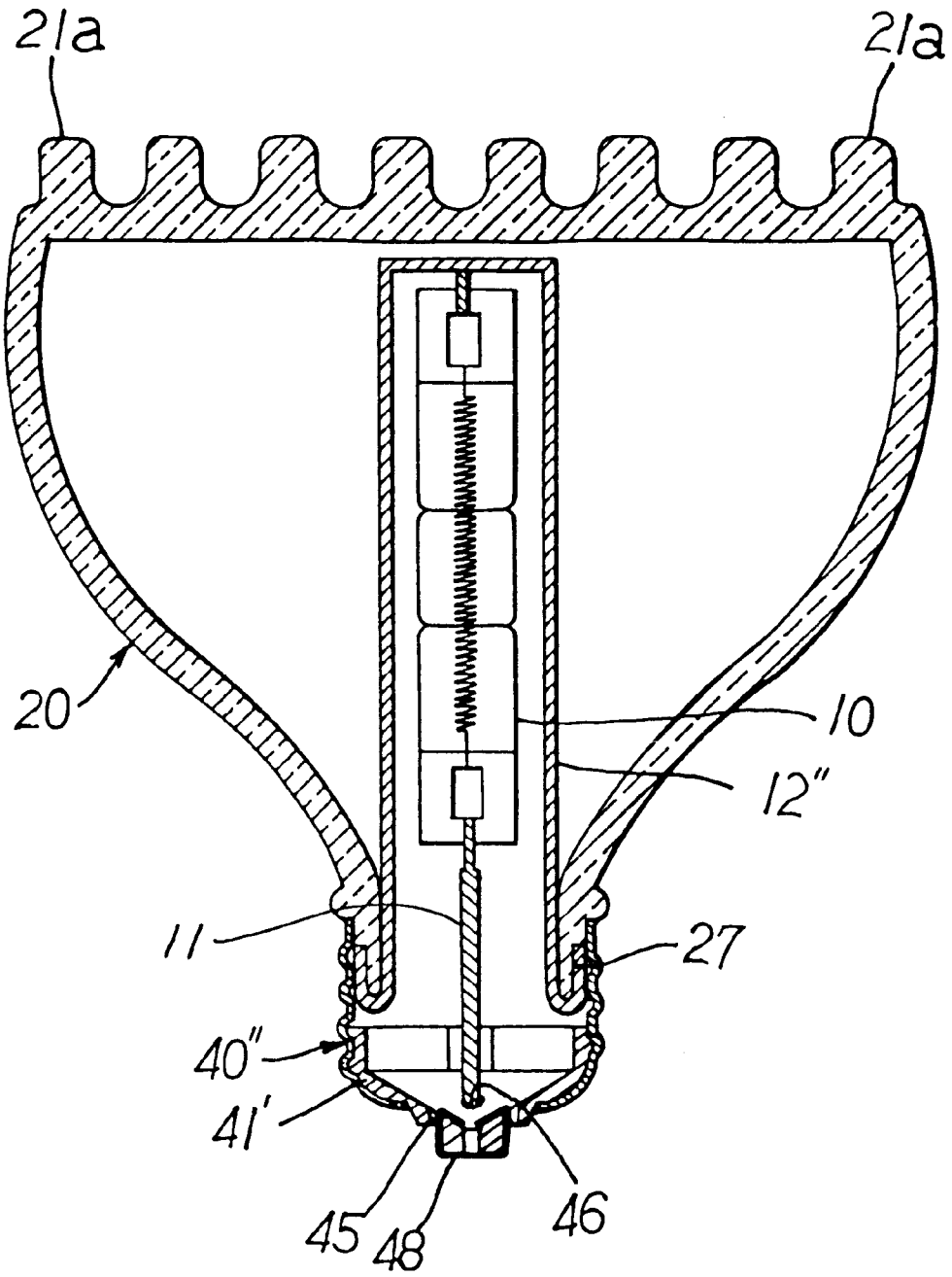
FIG. 13 shows a sectional view of the double-enveloped halogen bulb of the seventh preferred embodiment of the present invention.

FIGS. 12 and 13 show a double-enveloped halogen bulb according to the seventh preferred embodiment of the present invention. In this embodiment, the construction of the socket 40" is different from that of the socket 40 used in the first preferred embodiment shown in FIG. 1, and the fastening of the tubular halogen bulb 10 with the hollow glass envelope 20 is improved.

As shown in FIGS. 12 and 13, the socket 40" has a hollow columnar body 42 having a large opening at one end and a small opening at another end thereof. The hollow columnar body 42 is made of a metal material and is provided therein with female threads corresponding in location to and engageable with the male threads 28 of the neck of the glass envelope 20. The socket 40" further has an inner ceramic member 41' threadably mounted inside the hollow columnar body 42 so that a cylindrical end of the ceramic member 41' is protruding from the small opening of the hollow columnar body 42, and a copper hat 48 having two fastening legs 47. The ceramic member 41' is provided at another end and on the outer surface thereof with male threads 49 by which it is threadably engaged with the female threads of the hollow columnar body 42; and is also provided with two square holes 45 and two round holes 46 around the cylindrical end thereof. The copper hat 48 is fastened onto the protruding cylindrical end of the ceramic member 41' by inserting the two fastening legs 47 into the two square holes 45 of the ceramic member 41' and bending them toward each other. The hollow columnar body 42 and the copper hat 48 are the negative and positive electrodes of the socket 40", respectively.

The hollow glass envelope 20 of this embodiment is similar in construction to that of the sixth preferred embodiment of the present invention, except that the former is provided with two opposite grooves 27 on the outer surface of the neck of the glass envelope 20. The grooves 27 are perpendicular to the threads 28.

An inverted-U-shaped lead 12" having two hooks at both legs thereof is connected with one of the two conductive ends of the tubular halogen bulb 10 at the middle part thereof by soldering, and the two hooks are adapted to be received in the two grooves 27 of the glass envelope 20 separately. The tubular halogen bulb 10 is placed inside the glass envelope 20 via an opening 29 and is hung at the neck of the glass envelope 20 with the two hooks of the lead 12" received in the grooves 27. Another lead 11 is connected with another one of the two conductive ends of the tubular halogen bulb 10 at one end thereof, and another end thereof juts out from one of the two round holes 46 of the socket 40", and the protruding end 11 of said another lead 11 is soldered to the copper hat 48 after the socket 40" is threaded on the male threads 28 at the neck of the glass envelop 20, while the two hooks of the inverted-U-shaped lead 12" are electrically connected with the metal columnar body 42 of the socket 40".

EMBODIMENT 8

Figure 14:
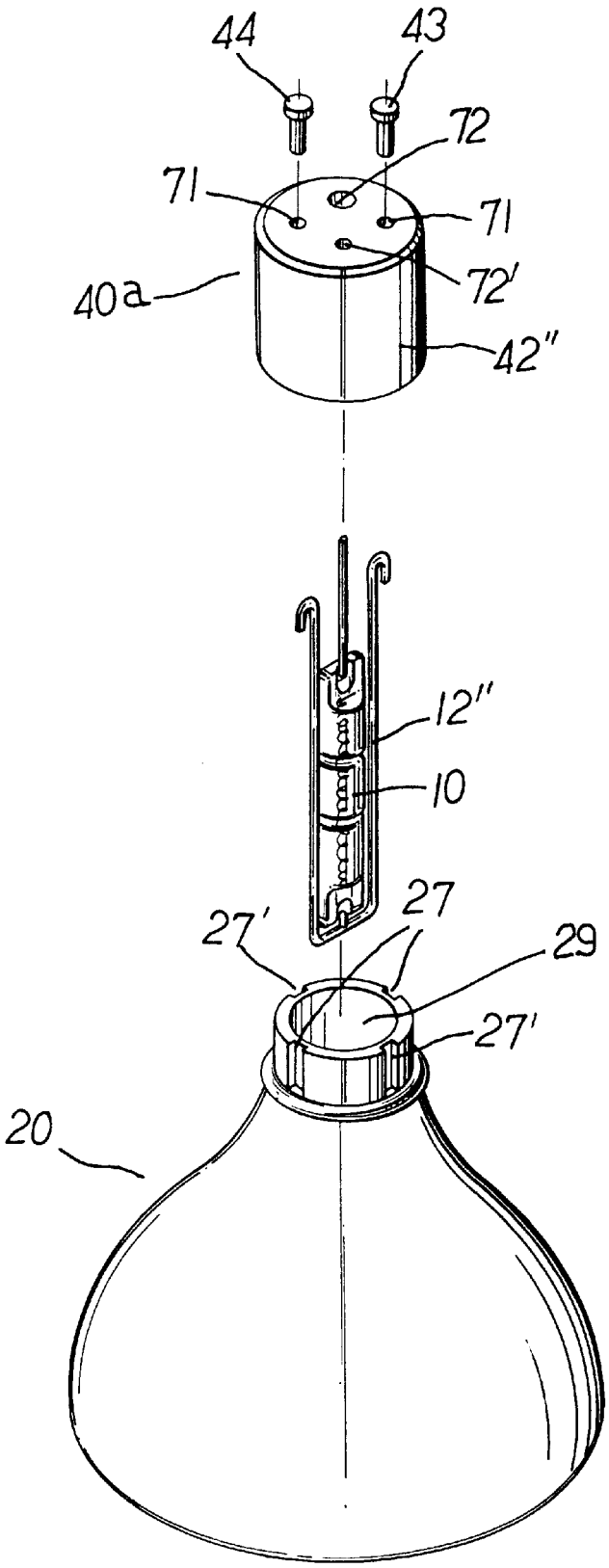
FIG. 14 shows an exploded view of a double-enveloped halogen bulb of an eighth preferred embodiment of the present invention.
Figure 15B:
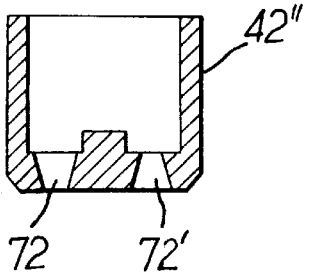
FIG. 15B shows a sectional view taken along the line B—B as shown in FIG. 15.
Figure 15A:
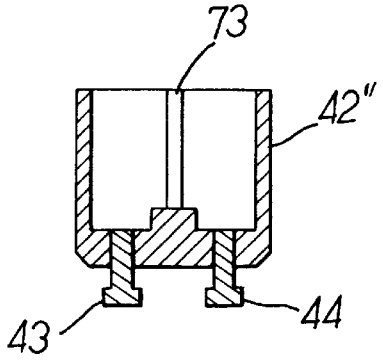
FIG. 15A shows a sectional view taken along the line A—A as shown in FIG. 15.
Figure 15:
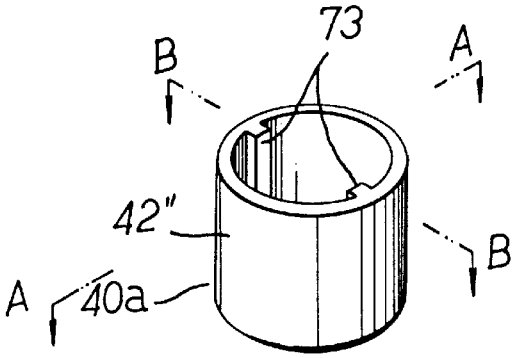
FIG. 15 shows a perspective view of the socket 40*a* of the double-enveloped halogen bulb in FIG. 14.
Figure 16:
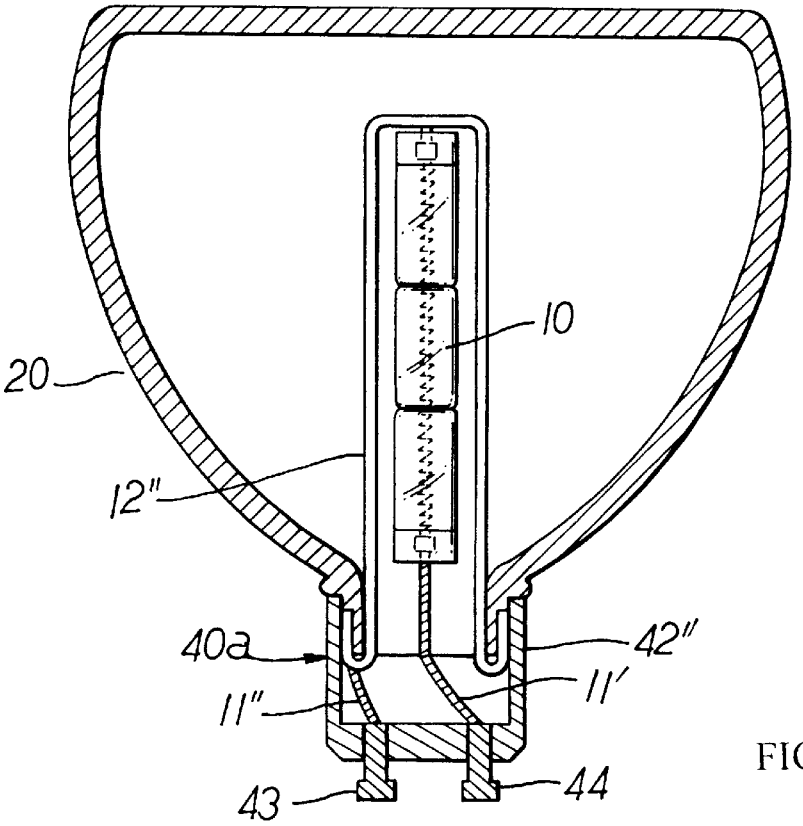
FIG. 16 shows a sectional view of the double-enveloped halogen bulb of the eighth preferred embodiment of the present invention.

FIGS. 14 to 16 show a double-enveloped halogen bulb according to the eighth preferred embodiment of the present invention. In this embodiment, the construction of the socket 40*a* is different from that of the socket 40" used in the seventh preferred embodiment shown in FIGS. 12 and 13.

The socket 40*a* is provided with a hollow columnar body 42" of a ceramic material having an opening at one end and a closed end at another end thereof, and two metal bodies 43 and 44 which are fixedly mounted inside two through holes 71 provided at said closed end of the hollow columnar body 42" by means of an ceramic cement. The hollow columnar body 42" is further provided with two ventilation holes 72 and 72' at the closed end thereof, each of which is located between the two through holes 71 so that the two ventilation holes 72, 72' and the two through holes 71 are spaced by 90 degrees with one another. The hollow columnar body 42" is further provided with two axial protuberant guides 73 on the inner wall thereof, which are spaced with each other by 180 degrees. Moreover, the hollow columnar body 42" has an inner diameter corresponding to the outer diameter of the neck of the glass envelope 20.

The hollow glass envelope 20 of this embodiment is similar in construction to that of the seventh preferred embodiment of the present invention, except that the former is provided with four vertical grooves 27, 27' on the outer surface and at the neck of the glass envelope 20, and the former does not have the threads 28 and parallel ridges 21*a* as provided respectively at the neck and on the top surface of the hollow glass envelope 20 in the latter. The four vertical grooves 27, 27' are spaced with one another by 90 degrees, and any opposite two of them are corresponding to the two axial protuberant guides 73 of the hollow columnar body 42" in shape and size.

The tubular halogen bulb 10 used in this embodiment is similar to that used in the seventh preferred embodiment of the present invention, except that said another lead 11 used in the latter is no longer needed in the former. Moreover, two additional leads 11', 11" are used to separately connect said one end of the two conductive ends and one leg of the inverted-U-shaped lead 12" with the two metal bodies 44 and 43 by soldering, before the tubular halogen bulb 10 is placed inside the glass envelope 20 via an opening 29 and is hung at the neck of the glass envelope 20 with the two hooks of the lead 12" being received in the grooves 27. Finally, the socket 40*a* is non-rotatably mounted on the neck of the glass envelope 20 with the help of the two axial protuberant guides 73 being received in the two vertical grooves 71' and by means of an ceramic cement.

EMBODIMENT 9

Figure 17:
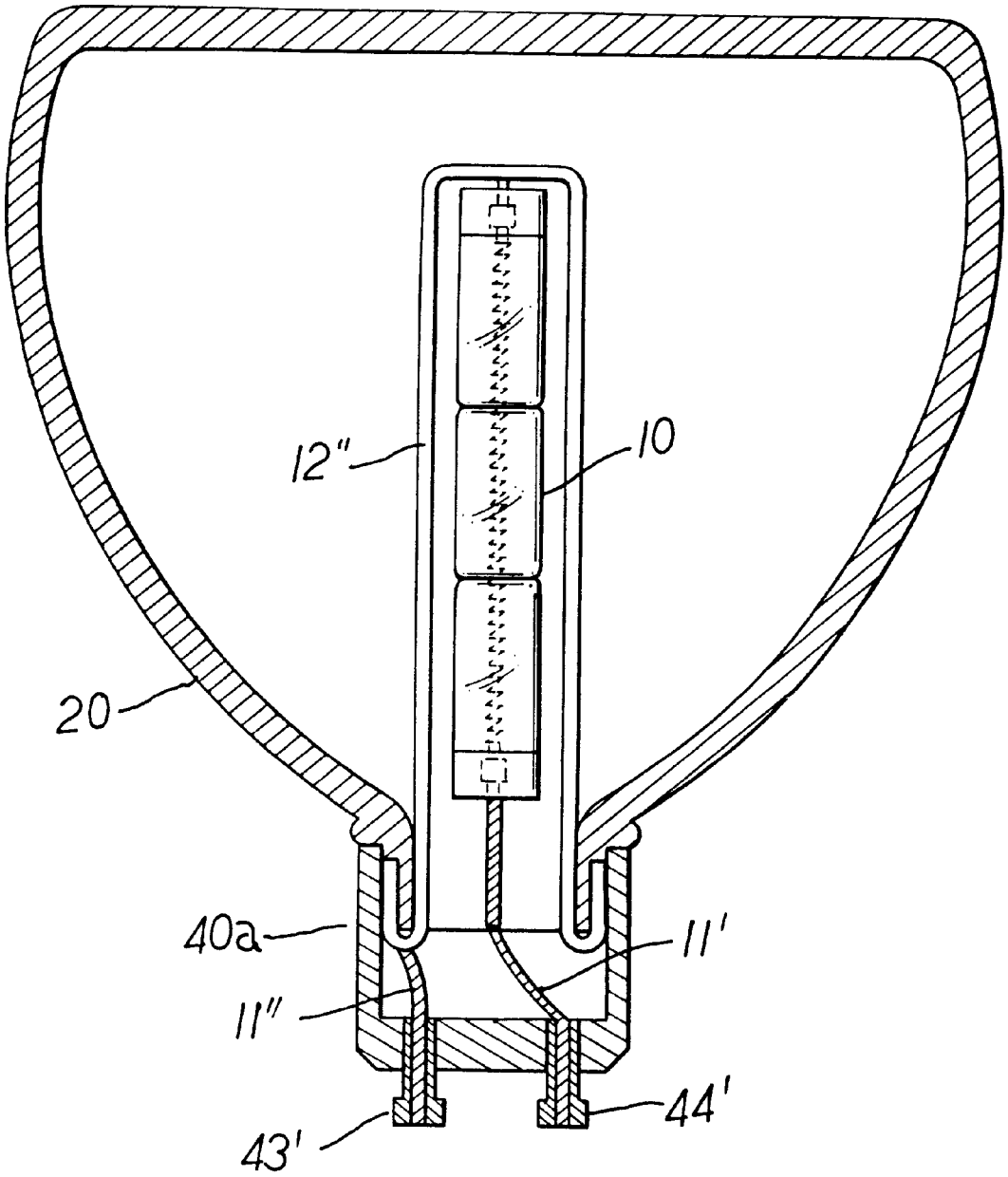
FIG. 17 shows a sectional view of the double-enveloped halogen bulb of the ninth preferred embodiment of the present invention.

As illustrated in FIG. 17, a double-enveloped halogen bulb according to the ninth preferred embodiment of the present invention is basically similar to that of the eighth preferred embodiment of the present invention, except that the two metal bodies 43', 44' of the former are hollow, and one ends of the two additional leads 11', 11" of the former are received inside the two hollow metal bodies 43', 44' and protruding therefrom before the protruding ends are soldered to the outer ends of the two hollow metal bodies 43', 44'. In this embodiment, another ends of the two additional leads 11', 11" are soldered to said one end 11 of the two conductive ends and one leg of the inverted-U-shaped leads 12", before the tubular halogen bulb 10 is placed inside the glass envelope 20 and is hung at the neck of the glass envelope 20. Said one ends of the two additional leads 11', 11" are inserted into two holes formed inside the two hollow metal bodies 43', 44' and protruding therefrom, when the socket 40*a* is mounted on the neck of the glass envelope 20. Finally the protruding ends of the two additional leads 11', 11" are soldered to the outer ends of the two metal bodies 43', 44' from outside.

What is claimed is:

1. A double-enveloped halogen bulb comprising a tubular halogen bulb having two conductive ends, a hollow glass envelope, and a socket for securing said tubular halogen bulb in said glass envelope such that said two conductive ends are connected electrically with two different portions of said socket, said tubular halogen bulb further having a quartz envelope, a metal filament located in said quartz envelope such that both ends of said metal filament are sealed at both ends of said quartz envelope and electrically connected to said two conductive ends separately, and a halogen mixture contained in said quartz envelope, said glass envelope having a thickness ranging between 2 mm and 8 mm, wherein said glass envelope has a neck provided at one end thereof with an opening and at another end thereof with a head, wherein said socket has a hollow columnar body having an opening at one end, and a closed end member fixedly connected to another end of said hollow columnar body; wherein said opening end of said neck of said glass envelope is received in said hollow columnar body via said opening of said hollow columnar body, wherein one of said two conductive ends or a lead connected to said one of said two conductive ends of said tubular halogen bulb is electrically connected to a first electrode provided on said closed end member of said hollow columnar body, and another one of said two conductive ends of said tubular halogen bulb is electrically connected to a second electrode provided on said hollow columnar body with another lead, and wherein one end of the said another lead is connected to said another end of said two conductive ends of said tubular halogen bulb, and said another end of said another lead is bent over an edge of the opening end of said neck and received in a first groove formed on the outer surface of the neck, so that said tubular halogen bulb is secured in said glass envelope when said opening end of said neck of said glass envelope is received in said hollow columnar body via said opening of said hollow columnar body of said socket, wherein said glass envelope has an outer surface which is opposite to said socket and is provided with a plurality of cylindrical protuberances or striplike protuberances perpendicular to said outer surface having a height ranging between 3 mm and 10 mm.

2. The double-enveloped halogen bulb as defined in claim 1, wherein said glass envelope has a thickness ranging between 3 mm and 6 mm.

3. The double-enveloped halogen bulb as defined in claim 1, wherein said glass envelope has an outer surface which is opposite to said socket and is provided with a plurality of cylindrical protuberances perpendicular to said outer surface and a top area ranging between 5 $mm^2$ and 25 $mm^2$.

4. The double-enveloped halogen bulb as defined in claim 3, wherein said outer surface is a planar surface with an area ranging between 3,000 $mm^2$ and 14,000 $mm^2$; and wherein said cylindrical protuberances are separated from one another at an interval ranging between 2 mm and 10 mm.

5. The double-enveloped halogen bulb as defined in claim 1, wherein said head of said glass envelope has an outer surface which is opposite to said socket and is provided with a plurality of striplike protuberances perpendicular to said outer surface and a width ranging between 3 mm and 10 mm, and a length equal to or smaller than a linear distance between two opposite points located at a peripheral edge of said outer surface.

6. The double-enveloped halogen bulb as defined in claim 5, wherein said outer surface is a planar surface with an area ranging between 3,000 $mm^2$ and 14,000 $mm^2$; and wherein said striplike protuberances are parallel to one another and are equidistantly arranged on said planar surface at an interval ranging 3–10 mm.

7. The double-enveloped halogen bulb as defined in claim 1, wherein said head is spherical, oblong, spindle, columnar, bowl-shaped, or funnel-shaped.

8. The double-enveloped halogen bulb as defined in claim 1, wherein said socket has a hollow columnar body having an opening at one end, and a closed end member fixed connected to another end of said hollow columnar body; wherein said opening end of said neck of said glass envelope is received in said hollow columnar body via said opening end of said hollow columnar body; and wherein said tubular halogen bulb is fixed in said glass envelope such that a longitudinal axis of said tubular halogen bulb is substantially parallel to a longitudinal axis of said hollow columnar body of said socket.

9. The double-enveloped halogen bulb as defined in claim 8, wherein said hollow columnar body of said socket is provided in an inner surface thereof with threads; and wherein said opening end of said glass envelope is further provided on an outer surface thereof with threads engageable with said threads of said hollow columnar body.

10. The double-enveloped halogen bulb as defined in claim 9, wherein said hollow columnar body is made of a metal material as the second electrode; wherein said closed end member is an insulation body having a central hole through which said one of said two conductive ends or said lead is bent and fastened by soldering to form the first electrode; and wherein said hollow columnar body is electrically connected to said another one of said two conductive ends with said another lead.

11. The double-enveloped halogen bulb as defined in claim 10, wherein said another lead is connected to said another one of said two conductive ends at said one end thereof by soldering; and said another end of said another lead is received in said first groove perpendicular to the threads of the neck, so that said another end of said another lead is electrically connected to said hollow columnar body when said socket is threaded on the threads of the neck of the glass envelope.

12. The double-enveloped halogen bulb as defined in claim 11, wherein said another lead is in an inverted-U-shaped lead having two hooks at both legs thereof, and said neck is further provided with a second groove on the outer surface thereof, wherein said inverted-U-shaped lead is connected to said another one of said two conductive ends at the middle portion thereof by soldering, and the two hooks are received in said first and second grooves separately, so that said two hooks are electrically connected to said hollow columnar body when said socket is threaded on the threads of the neck of the glass envelope.

13. The double-enveloped halogen bulb as defined in claim 8, wherein said hollow columnar body and said closed end member of said socket are integrally made of an electrically non-conductive material; wherein a closed end of said socket is provided with two conductive bodies as the first and second electrodes separated from each other and connected electrically with said two conductive ends of said tubular halogen bulb, respectively.

14. The double-enveloped halogen bulb as defined in claim 13, wherein said electrically non-conductive material is plastic, and said socket and said opening end of said neck of said glass envelope are fastened by an adhesive.

15. The double-enveloped halogen bulb as defined in claim 13, wherein said socket is further provided with one or more ventilation holes at said closed end thereof.

16. The double-enveloped halogen bulb as defined in claim 1, wherein said glass envelope is made integrally.

17. A double-enveloped halogen bulb comprising a tubular halogen bulb having two conductive ends, a hollow glass envelope, and a socket for securing said tubular halogen bulb in said glass envelope such that said two conductive ends are connected electrically with two different portions of said socket, said tubular halogen bulb further having a quartz envelope, a metal filament located in said quartz envelope such that both ends of said metal filament are sealed at both ends of said quartz envelope and electrically connected to said two conductive ends separately, and a halogen mixture contained in said quartz envelope, said glass envelope having a thickness ranging between 2 mm and 8 mm, wherein said glass envelope has a neck provided at one end thereof with an opening and at another end thereof with a head;

wherein said socket has a hollow columnar body having an opening at one end, and a closed end member fixedly connected to another end of said hollow columnar body;

wherein said opening end of said neck of said glass envelope is received in said hollow columnar body via said opening of said hollow columnar body, wherein one of said two conductive ends or a lead connected to said one of said two conductive ends of said tubular halogen bulb is electrically connected to a first electrode provided on said closed end member of said hollow columnar body, and another one of said two conductive ends of said tubular halogen bulb is electrically connected to a second electrode provided on said hollow columnar body with another lead, and wherein one end of the said another lead is connected to said another end of said two conductive ends of said tubular halogen bulb, and said another end of said another lead is bent over an edge of the opening end of said neck and received in a first groove formed on the outer surface of the neck, so that said tubular halogen bulb is secured in said glass envelope when said opening end of said neck of said glass envelope is received in said hollow columnar body via said opening of said hollow columnar body of said socket;

wherein said tubular halogen bulb is fixed in said glass envelop such that a longitudinal axis of said tubular halogen bulb is substantially perpendicular to a longitudinal axis of said hollow columnar body of said socket; and wherein said glass envelope has a plurality of ventilation holes.

18. The double-enveloped halogen bulb as defined in claim 17, further comprising a bracket for supporting said tubular halogen bulb, said bracket provided at one end thereof with two legs fastened respectively with said socket and/or between said socket and said neck of said glass envelope, said bracket further provided at another end thereof with two arms holding proximity of both ends of said tubular halogen bulb, wherein one of said two legs serves as said another lead.

19. The double-enveloped halogen bulb as defined in claim 17, wherein said ventilation holes are formed in such a manner that said tubular halogen bulb can not be seen by the naked eye through said ventilation holes.

20. The double-enveloped halogen bulb as defined in claim 17, wherein said glass envelope has a cap and a funnel-shaped portion having a first open end and a second open end, said first open end being fastened with said socket, said second open end having an opening larger than an opening of said first open end, said second open end being capped by said cap of said glass envelope.

21. The double-enveloped halogen bulb as defined in claim 20, wherein said cap is fastened with said second open end of said funnel-shaped portion by an adhesive.

22. The double-enveloped halogen bulb as defined in claim 21, wherein said cap is provided with a retaining portion; and wherein said second open end of said funnel-shaped portion is provided with a retaining portion engageable with said retaining portion of said cap.

23. The double-enveloped halogen bulb as defined in claim 22, wherein said cap has a surface facing said funnel-shaped portion and having a periphery provided with a protruded edge perpendicular to said surface; and wherein said second open end of said funnel-shaped portion is provided in a periphery thereof with a protuberance corresponding in location to said protruded edge of said cap.

24. The double-enveloped halogen bulb as defined in claim 22, wherein said cap has a surface facing said funnel-shaped portion and having a periphery provided with a plurality of wedges separated from one another and perpendicular to said surface; and wherein said second open end of said funnel-shaped portion is provided in a periphery thereof with a plurality of recesses corresponding in location and size to said wedges of said cap.

25. The double-enveloped halogen bulb as defined in claim 20, wherein said ventilation holes are formed in such a manner that said tubular halogen bulb can not be seen by the naked eye through said ventilation holes.

26. The double-enveloped halogen bulb as defined in claim 25, wherein said ventilation holes are located near a portion where said cap and said funnel-shaped portion are engaged with each other.

27. The double-enveloped halogen bulb as defined in claim 26, wherein said ventilation holes are located at an area contiguous to said second open end of said funnel-shaped portion.

28. A double-enveloped halogen bulb comprising a tubular halogen bulb having two conductive ends, a hollow glass envelope, and a socket for securing said tubular halogen bulb in said glass envelope such that said two conductive ends are connected electrically with two different portions of said socket, said tubular halogen bulb further having a quartz envelope, a metal filament located in said quartz envelope such that both ends of said metal filament are sealed at both ends of said quartz envelope and electrically connected to said two conductive ends separately, and a halogen mixture contained in said quartz envelope, said glass envelope having a thickness ranging between 2 mm and 8 mm, wherein said glass envelope has a neck provided at one end thereof with an opening and at another end thereof with a head, wherein said socket has a hollow columnar body having an opening at one end, and a closed end member fixedly connected to another end of said hollow columnar body;

wherein said opening end of said neck of said glass envelope is received in said hollow columnar body via said opening of said hollow columnar body, wherein one of said two conductive ends or a lead connected to said one of said two conductive ends of said tubular halogen bulb is electrically connected to a first electrode provided on said closed end member of said hollow columnar body, and another one of said two conductive ends of said tubular halogen bulb is electrically connected to a second electrode provided on said hollow columnar body with another lead, and wherein one end of the said another lead is connected to said another end of said two conductive ends of said tubular halogen bulb, and said another end of said another lead is bent over an edge of the opening end of said neck and received in a first groove formed on the outer surface of the neck, so that said tubular halogen bulb is secured in said glass envelope when said opening end of said neck of said glass envelope is received in said hollow columnar body via said opening of said hollow columnar body of said socket;

wherein said tubular halogen bulb is substantially parallel to a longitudinal axis of said hollow columnar body of said socket;

wherein said hollow columnar body of said socket is provided in an inner surface thereof with threads;

wherein said opening end of said glass envelope is further provided on an outer surface thereof with threads engageable with said threads of said hollow columnar body;

wherein said hollow columnar body is made of a metal material as the second electrode, and said closed end member is an insulation body threadably mounted inside the hollow columnar body with a cylindrical end of said closed end member protruding from said another end of said hollow columnar body;

wherein said closed end member is provided with two square holes and one round hole around said cylindrical end thereof, wherein said socket further has a copper hat as the first electrode having two fastening legs on the rim of the copper hat; and wherein the copper hat is fastened onto the protruding cylindrical end of the closed end member by inserting the two fastening legs into the two square holes of the closed end member and bending them toward each other, said one of said two conductive ends or said lead is passed through said round hole and soldered to said copper hat, and said hollow columnar body is electrically connected to said another one of said two conductive ends with said another lead.

29. The double-enveloped halogen bulb as defined in claim 28, wherein said another lead is connected to said another one of said two conductive ends at said one end thereof by soldering; and said another end of said another lead is received in said first groove perpendicular to the threads of the neck, so that said another end of said another lead is electrically connected to said hollow columnar body when said socket is threaded on the threads of the neck of the glass envelope.

30. The double-enveloped halogen bulb as defined in claim 29, wherein said another lead is in an inverted-U-shaped lead having two hooks at both legs thereof, and said neck is further provided with a second groove on the outer surface thereof, wherein said inverted-U-shaped lead is connected to said another one of said two conductive ends at the middle portion thereof by soldering, and the two hooks are received in said first and second grooves separately, so that said two hooks are electrically connected to said hollow columnar body when said socket is threaded on the threads of the neck of the glass envelope.

31. A double-enveloped halogen bulb comprising a tubular halogen bulb having two conductive ends, a hollow glass envelope, and a socket for securing said tubular halogen bulb in said glass envelope such that said two conductive ends are connected electrically with two different portions of said socket, said tubular halogen bulb further having a quartz envelope, a metal filament located in said quartz envelope such that both ends of said metal filament are sealed at both ends of said quartz envelope and electrically connected to said two conductive ends separately, and a halogen mixture contained in said quartz envelope, said glass envelope having a thickness ranging between 2 mm and 8 mm, wherein said glass envelope has a neck provided at one end thereof with an opening and at another end thereof with a head, wherein said socket has a hollow columnar body having an opening at one end, and a closed end member fixedly connected to another end of said hollow columnar body;

wherein said opening end of said neck of said glass envelope is received in said hollow columnar body via said opening of said hollow columnar body, wherein one of said two conductive ends or a lead connected to said one of said two conductive ends of said tubular halogen bulb is electrically connected to a first electrode provided on said closed end member of said hollow columnar body, and another one of said two conductive ends of said tubular halogen bulb is electrically connected to a second electrode provided on said hollow columnar body with another lead, and wherein one end of the said another lead is connected to said another end of said two conductive ends of said tubular halogen bulb, and said another end of said another lead is bent over an edge of the opening end of said neck and received in a first groove formed on the outer surface of the neck, so that said tubular halogen bulb is secured in said glass envelope when said opening end of said neck of said glass envelope is received in said hollow columnar body via said opening of said hollow columnar body of said socket;

wherein said tubular halogen bulb is substantially parallel to a longitudinal axis of said hollow columnar body of said socket;

wherein said hollow columnar body and said closed end member of said socket are integrally made of an electrically non-conductive material;

wherein a closed end of said socket is provided with two conductive bodies as the first and second electrodes separated from each other and connected electrically with said two conductive ends of said tubular halogen bulb, respectively;

two additional leads, wherein said another lead is an inverted-U-shaped lead having two hooks at both legs thereof, and said neck is further provided with a second groove on the outer surface thereof, wherein said inverted-U-shaped lead is connected to said another one of said two conductive ends at the middle portion thereof by soldering, and the two hooks are received in said first and second grooves separately, wherein one leg of said inverted-U-shaped lead and said one of said two conductive ends of said tubular halogen bulb are electrically connected to said two conductive bodies with said two additional leads separately; and wherein said two conductive bodies are hollow, one end of the two additional leads are received inside the two hollow conductive bodies and protruding therefrom separately, the protruding ends of the two additional leads are separately connected to one end of the two hollow conductive bodies by soldering, and another end of the two additional leads are separately connected to said one leg of said inverted-U-shaped lead and said another end of said two conductive ends of said tubular halogen bulb by soldering.

32. The double-enveloped halogen bulb as defined in claim 31, wherein said hollow columnar body of said socket is further provided with two axial protuberant guides on the inner wall thereof, said hollow columnar body of said socket has an inner diameter corresponding to an outer diameter of the neck of the glass envelope, and said glass envelope is provided with two additional grooves corresponding to said two axial protuberant guides on an outer surface of said opening end of said neck thereof, so that the socket is non-rotatably mounted on the neck of the glass envelope with the two axial protuberant guides being received in the two additional grooves of said neck respectively.

33. The double-enveloped halogen bulb as defined in claim 31, wherein said electrically non-conductive material is a ceramic material.

34. The double-enveloped halogen bulb as defined in claim 33, wherein said socket and said opening end of said neck of said glass envelope are fastened by a ceramic cement.

35. The double-enveloped halogen bulb as defined in claim 33, wherein said two conductive bodies are separately received in two through holes provided at said closed end of said socket and fastened by means of a ceramic cement.

36. The double-enveloped halogen bulb as defined in claim 31, wherein said socket is further provided with one or more ventilation holes at said closed end thereof.

* * * * *